US010698346B2

(12) United States Patent
Matsuzaki

(10) Patent No.: US 10,698,346 B2
(45) Date of Patent: Jun. 30, 2020

(54) IMAGE FORMING APPARATUS

(71) Applicant: CANON KABUSHIKI KAISHA, Tokyo (JP)

(72) Inventor: Kenta Matsuzaki, Noda (JP)

(73) Assignee: Canon Kabushiki Kaisha, Tokyo (JP)

( * ) Notice: Subject to any disclaimer, the term of this patent is extended or adjusted under 35 U.S.C. 154(b) by 137 days.

(21) Appl. No.: 15/935,604

(22) Filed: Mar. 26, 2018

(65) Prior Publication Data

US 2018/0284654 A1 Oct. 4, 2018

(30) Foreign Application Priority Data

Mar. 30, 2017 (JP) ..... 2017-068880

(51) Int. Cl.
*G03G 15/16* (2006.01)

(52) U.S. Cl.
CPC ..... *G03G 15/161* (2013.01); *G03G 15/1685* (2013.01); *G03G 2215/1661* (2013.01)

(58) Field of Classification Search
CPC ..... G03G 15/161; G03G 15/1685; G03G 15/1661
See application file for complete search history.

(56) References Cited

U.S. PATENT DOCUMENTS

2011/0206399 A1* 8/2011 Fujita ..... G03G 15/50 399/49

FOREIGN PATENT DOCUMENTS

| | | | |
|---|---|---|---|
| JP | 2005-037596 | A | 2/2005 |
| JP | 2006-184547 | A | 7/2006 |
| JP | 2010-20006 | A | 1/2010 |
| JP | 2012-181457 | A | 9/2012 |

* cited by examiner

*Primary Examiner* — David M. Gray
*Assistant Examiner* — Michael A Harrison
(74) *Attorney, Agent, or Firm* — Canon U.S.A., Inc. I.P. Division

(57) ABSTRACT

An idler roller as at least one of a plurality of support rollers for stretching an intermediate transfer belt is a metal roller having a groove formed on a metal surface. A primary transfer roller is a metal roller having a metal surface with a smaller maximum surface height than the idler roller.

20 Claims, 8 Drawing Sheets

FIG.6

| | | MATERIAL | DIAMETER (mm) |
|---|---|---|---|
| IDLER ROLLER 61 | | METAL ROLLER (GROOVED) | 12 |
| SECONDARY INNER TRANSFER ROLLER (DRIVE ROLLER) 62 | | RUBBER ROLLER | 16 |
| TENSION ROLLER 63 | | METAL ROLLER (GROOVE-LESS) | 21 |
| SUPPORT ROLLER 67 | | METAL ROLLER (GROOVED) | 10 |
| PRIMARY TRANSFER ROLLER | 54a | METAL ROLLER (GROOVE-LESS) | 8 |
| | 54b | METAL ROLLER (GROOVE-LESS) | 8 |
| | 54c | METAL ROLLER (GROOVE-LESS) | 8 |
| | 54d | METAL ROLLER (GROOVE-LESS) | 8 |

DISTORTION AMOUNT

IMAGE FORMING APPARATUS

BACKGROUND OF THE INVENTION

Field of the Invention

The present disclosure relates to an image forming apparatus, such as a copying machine, printer, facsimile, and multifunction peripheral having a plurality of functions of these apparatuses.

Description of the Related Art

In a conventionally known configuration of an image forming apparatus, for example, toner images are transferred from photosensitive drums as image bearing members to an intermediate transfer belt, and then transferred from the intermediate transfer belt to a recording material. The intermediate transfer belt is stretched by a plurality of support rollers. The inner circumferential surface of the intermediate transfer belt is in contact with transfer rollers for transferring toner images from the photosensitive drums to the intermediate transfer belt when a voltage is applied to the transfer rollers.

Metal rollers are used as such transfer rollers in a known configuration. For example, Japanese Patent Application Laid-Open No. 2006-184547 discusses a configuration for preventing the occurrence of a high density point-like defect by setting the sum of the arithmetic average roughness of the surface of a transfer roller and the arithmetic average roughness of the inner circumferential surface of the intermediate transfer belt to 1.2 μm or less.

In some cases, metal rollers may be used as support rollers for stretching the intermediate transfer belt. However, when metal rollers discussed in Japanese Patent Application Laid-Open No. 2006-184547 are used as support rollers, there arises the following problems.

More specifically, dust or a developer may enter the inside of the intermediate transfer belt. If dust enters between a support roller and the belt, the pressure applied to the belt will be locally increased because of the height of dust. As a result, a streak-like deformation (tension lines) may occur in the circumferential direction at a portion of the belt in the width direction. If tension lines occur, toner image transfer may become uneven possibly resulting in the formation of a streak-like image.

Meanwhile, if a transfer roller has portions with a large gap to the belt and portions with a small or no gap thereto in the axial direction, an uneven current may arise in the axial direction, possibly resulting in uneven density in a transferred image.

SUMMARY OF THE INVENTION

The present disclosure is directed to offering a configuration for preventing the occurrence of not only tension lines but also uneven density of a transfer image.

According to an aspect of the present disclosure, an image forming apparatus includes an image bearing member configured to bear a latent image formed thereon, an endless intermediate transfer belt configured to hold a toner image transferred from the image bearing member, a plurality of support rollers configured to stretch the intermediate transfer belt, the plurality of support rollers including a first metal roller with a metal outer circumferential surface, and a second metal roller with a metal outer circumferential surface, configured to contact an inner surface of the intermediate transfer belt to form a transfer portion, and transfer the toner image borne by the image bearing member to the intermediate transfer belt when a transfer bias is applied to the second metal roller. The first metal roller is provided with a concave portion formed in 90% or more of an image forming area, the concave portion having a depth of 10 μm or more and a width of 50 μm or more and 5 mm or less. The second metal roller has a maximum surface height Ry of 25 μm or less in the image forming area. The maximum surface height Ry of the first metal roller is larger than the maximum surface height Ry of the second metal roller by 10 μm or more.

Further features of the present disclosure will become apparent from the following description of exemplary embodiments with reference to the attached drawings.

BRIEF DESCRIPTION OF THE DRAWINGS

FIG. 6 is a table illustrating the material and diameter of each roller.

DESCRIPTION OF THE EMBODIMENTS

Figure 1:
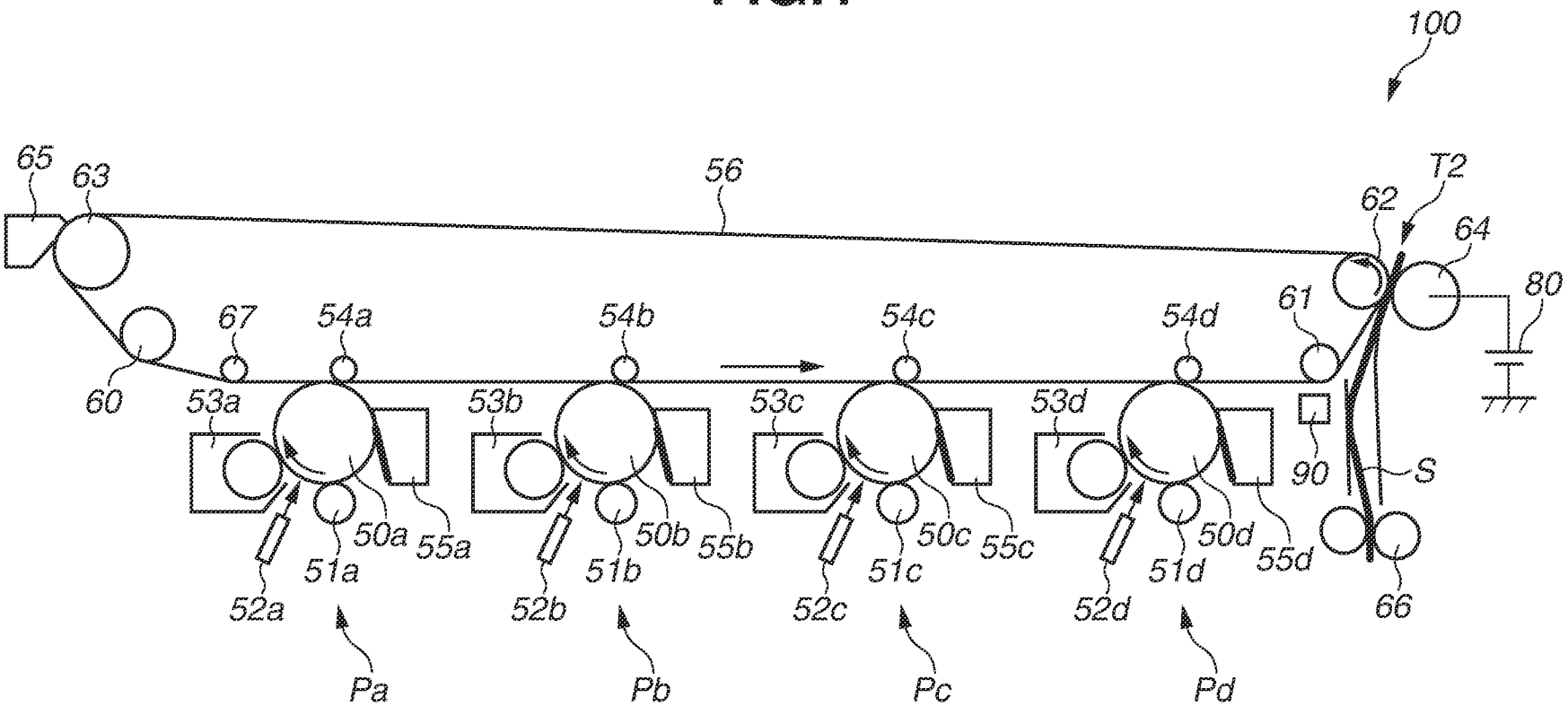
FIG. 1 illustrates an overall configuration of an image forming apparatus according to an exemplary embodiment.

An exemplary embodiment will be described below with reference to FIGS. 1 to 8. An overall configuration of an image forming apparatus according to the present exemplary embodiment will be described below with reference to FIG. 1.

[Image Forming Apparatus]

An image forming apparatus 100 is an electrophotographic full color printer having four image forming units Pa, Pb, Pc, and Pd provided for four different colors, yellow, magenta, cyan, and black, respectively. The image forming apparatus 100 according to the present exemplary embodiment is of a tandem type in which the image forming units Pa, Pb, Pc, and Pd are arranged along the rotational direction of an intermediate transfer belt 56 (described below). The image forming apparatus 100 forms a toner image on a recording material S according to an image signal from a host apparatus such as a document reading apparatus (not illustrated) connected to the main body of the image forming apparatus 100 or a personal computer communicably connected to the main body of the image forming apparatus 100. Recording materials include sheet materials such as paper, plastic films, and cloths.

An overview of an image forming process will be described below. The image forming units Pa, Pb, Pc, and Pd form toner images of different colors on photosensitive drums 50*a*, 50*b*, 50*c*, and 50*d*, respectively. The toner images of respective colors formed in this way are respectively transferred from the photosensitive drums 50*a*, 50*b*, 50*c*, and 50*d* onto the intermediate transfer belt 56 and subsequently transferred from the intermediate transfer belt 56 onto the recording material S. The recording material S with the toner images transferred thereon is conveyed to a fixing apparatus (not illustrated) by which the toner images are fixed to the recording material S. The image forming apparatus 100 will be described in more detail below.

The four image forming units Pa Pb, Pc, and Pd included in the image forming apparatus 100 have substantially the same configuration except that development colors are different. Therefore, the image forming unit Pa will be described below on a representative basis. For components of other image forming units, the subscript "a" in reference numerals assigned to components of the image forming unit Pa is considered to be replaced with "b", "c", and "d", respectively, and redundant descriptions thereof will be omitted.

The image forming unit Pa is provided with a cylindrical photosensitive member, i.e., the photosensitive drum 50*a* as an image bearing member. Referring to FIG. 1, the photosensitive drum 50*a* is driven to rotate in the direction indicated by an arrow. A charging roller 51*a* (charging apparatus), a development apparatus 53*a*, a primary transfer roller 54*a*, and a cleaning apparatus 55*a* are disposed around the photosensitive drum 50*a*. An exposure apparatus (laser scanner) 52*a* is disposed below the photosensitive drum 50*a*.

The intermediate transfer belt 56 is disposed to face the photosensitive drums 50*a*, 50*b*, 50*c*, and 50*d*. The intermediate transfer belt 56 is stretched by a plurality of support rollers, and circumferentially moves (rotates) in the direction indicated by an arrow by the drive of a secondary inner transfer roller 62 which also serves as a drive roller. At a position facing the secondary inner transfer roller 62 across the intermediate transfer belt 56, a secondary outer transfer roller 64 as a secondary transfer member is disposed to form a secondary transfer portion T2 where a toner image on the intermediate transfer belt 56 is transferred to the recording material S. A fixing apparatus is disposed on the downstream side of the secondary transfer portion T2 in the recording material conveyance direction.

An image forming process performed by the image forming apparatus 100 having the above-described configuration will be described below. First of all, when an image forming operation is started, the surface of the rotating photosensitive drum 50*a* is uniformly charged by the charging roller 51*a*. Subsequently, the photosensitive drum 50*a* is exposed to laser light corresponding to an image signal generated by the exposure apparatus 52*a*. In this way, an electrostatic latent image according to the image signal is formed on the photosensitive drum 50*a*. The electrostatic latent image on the photosensitive drum 50*a* is visualized by a developer (toner) stored in the development apparatus 53*a* and becomes a visible image. Although, in the present exemplary embodiment, a two-component developer containing non-magnetic toner and magnetic carriers is used, a mono-component developer containing magnetic toner is also usable.

The toner image formed on the photosensitive drum 50*a* is primarily transferred to the intermediate transfer belt 56 at a primary transfer portion T1 (see FIG. 2) formed between the photosensitive drum 50*a* and the primary transfer roller 54*a* disposed across the intermediate transfer belt 56. Toner (transfer residual toner) remaining on the surface of the photosensitive drum 50*a* after primary transfer is removed by the cleaning apparatus 55*a*.

The image forming units for magenta, cyan, and black sequentially perform the similar operation to superimpose toner images of four different colors on the intermediate transfer belt 56. Subsequently, in synchronization with the timing of the toner image forming operation, the recording material S stored in a cassette (not illustrated) is conveyed to the secondary transfer portion T2 by a registration roller 66. Then, the toner images of four different colors on the intermediate transfer belt 56 are secondarily transferred onto the recording material S in a collective way. More specifically, according to the present exemplary embodiment, the cassette, a pickup roller (not illustrated), the registration roller 66, etc. are provided. The cassette stores the recording materials S. The pickup roller takes out and conveys the recording material S stored in the cassette at predetermined timing. The registration roller 66 conveys the recording material S taken out by the pickup roller to the secondary transfer portion T2.

Toner remaining on the intermediate transfer belt 56, i.e., toner not having been transferred at the secondary transfer portion T2, is removed by a belt cleaning apparatus 65. More specifically, the belt cleaning apparatus 65 is disposed on the downstream side of the secondary transfer portion T2 in the rotational direction of the intermediate transfer belt 56. The belt cleaning apparatus 65 removes residual toner and paper powder on the intermediate transfer belt 56 after secondary transfer to clean the surface of the intermediate transfer belt 56.

Then, the recording material S is conveyed to the fixing apparatus. When the recording material S is heated and pressurized by the fixing apparatus, toner on the recording material S is melted, mixed, and fixed to the recording material S as a full color image. Then, the recording material S is discharged to the outside of the image forming apparatus 100. This completes a series of the image forming process. It is also possible to form a monochrome image of a desired color or an image of a plurality of colors by using only desired image forming units.

[Intermediate Transfer Belt]

The intermediate transfer belt 56 will be described below. The intermediate transfer belt 56 is disposed so that the outer circumferential surface thereof contacts the photosensitive drums 50*a*, 50*b*, 50*c*, and 50*d*, and rotates in the direction of the arrow. As described above, toner images are primarily transferred from the photosensitive drums 50*a*, 50*b*, 50*c*, and 50*d* to the intermediate transfer belt 56.

According to the present exemplary embodiment, the intermediate transfer belt 56 is an endless belt made of a resin (polyimide or polyamide), a resin alloy, or a certain type of rubber containing a suitable amount of anti-static additive such as carbon black. The intermediate transfer belt 56 is configured in film form, for example, having a surface resistivity of 1E+9 to 1E+13 Ω/sq. and a thickness of about 0.04 to 0.5 mm.

The intermediate transfer belt 56 is stretched by a plurality of support rollers: support rollers 60 and 67, an idler roller 61, the secondary inner transfer roller 62, and a tension roller 63. The tension roller 63 is configured to apply a fixed tension (for example, 29.4 to 117.6 N (3 to 12 kgf)) to the intermediate transfer belt 56.

The intermediate transfer belt 56 is circularly driven (rotated) at a predetermined speed by rotatably driving the secondary inner transfer roller 62 via a driving apparatus (not illustrated). The secondary inner transfer roller (drive roller) 62 is a metal roller with rubber wound around the surface. This rubber increases the frictional force between the intermediate transfer belt 56 and the secondary inner transfer roller 62 so that a slip does not easily occur.

The idler roller 61 as a pre-drive roller is disposed at an adjacent position on the upstream side of the secondary inner transfer roller 62 in the rotational direction of the intermediate transfer belt 56. The stretching surface of the intermediate transfer belt 56 stretched by the support roller 67 and the idler roller 61 faces the photosensitive drums 50*a*, 50*b*, 50*c*, and 50*d*. Therefore, the primary transfer rollers 54*a*, 54*b*, 54*c*, and 54*d* as transfer rollers are disposed between the support roller 67 and the idler roller 61, so as to contact the inner circumferential surface of the intermediate transfer belt 56.

When the primary transfer rollers 54*a*, 54*b*, 54*c*, and 54*d* are applied with a voltage having the polarity opposite to the charging polarity of toner, toner images are sequentially electrostatistically attracted (primarily transferred) from the photosensitive drums 50*a*, 50*b*, 50*c*, and 50*d* to the intermediate transfer belt 56, respectively. As a result, toner images of respective colors are superimposed onto the intermediate transfer belt 56. The configuration of the primary transfer portion will be described in detail below.

The secondary inner transfer roller 62 as a drive roller is disposed so as to contact the inner circumferential surface of the intermediate transfer belt 56 to nip the intermediate transfer belt 56 with the secondary outer transfer roller 64 as a secondary transfer member. The secondary outer transfer roller 64 is disposed on the side of the toner image bearing surface (outer circumferential surface) of the intermediate transfer belt 56 so as to contact the outer circumferential surface of the intermediate transfer belt 56. When applied with a voltage, the secondary outer transfer roller 64 transfers the toner image from the intermediate transfer belt 56 to the recording material S. The secondary outer transfer roller 64 configured in this way is connected with a power source 80 and applied with a voltage having the polarity opposite to the charging polarity of toner.

More specifically, during the image forming operation, the secondary outer transfer roller 64 rotates being driven by the running of the intermediate transfer belt 56. After completion of various control, the recording material S is conveyed to the secondary transfer portion T2. At this timing, to secondarily transfer the toner image formed on the intermediate transfer belt 56 to the recording material S, the secondary outer transfer roller 64 is applied with a secondary transfer bias having the polarity opposite to the charging polarity of toner. According to the present exemplary embodiment, toner has a negative charging polarity and the secondary transfer bias is a positive bias.

The secondary inner transfer roller 62 is a rubber roller formed of a metal core and an elastic layer around the metal core surface. The elastic layer is made of ethylene propylene diene rubber (EPDM). For example, the secondary inner transfer roller 62 is formed to have a roller diameter of 16 mm and a rubber thickness of 0.5 mm. The hardness is set, for example, to 70 degrees (Asker C hardness meter). In addition, the secondary outer transfer roller 64 may be formed by winding 1-mm-thick silicon rubber around the metal core. Meanwhile, the secondary outer transfer roller 64 is formed of a metal core and an elastic layer around the metal core. The elastic layer is made of nitrile rubber (NBR) or EPDM containing a conductive agent, such as a metal complex and carbon. For example, the secondary outer transfer roller 64 is formed to have a roller diameter of 24 mm and an elastic layer thickness of 6 mm.

[Primary Transfer Portion]

Figure 2:
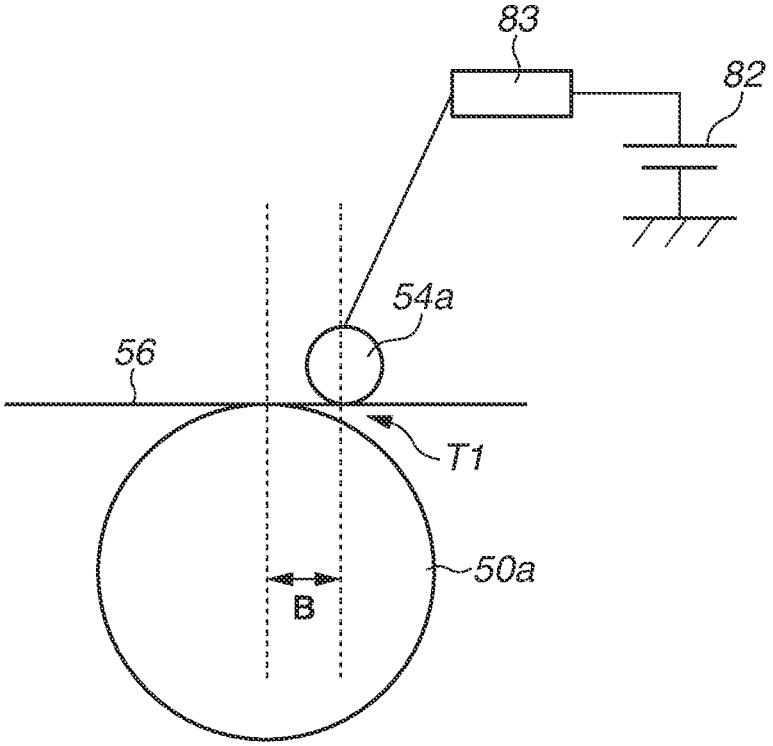
FIG. 2 schematically illustrates a configuration of a primary transfer portion according to the exemplary embodiment.

The configuration of the primary transfer portion T1 will be described below with reference to FIG. 2. FIG. illustrates a positional relation between the photosensitive drum 50*a* and the primary transfer roller 54*a* in the image forming unit Pa according to the present exemplary embodiment. This configuration also applies to other image forming units.

The primary transfer roller 54*a* is connected with a power source 82. The power source 82 is controlled by a bias control apparatus 83 to apply to the primary transfer roller 54*a* a primary transfer bias for primarily transferring the toner image on the photosensitive drum 50*a* to the intermediate transfer belt 56. The primary transfer bias is a positive bias similar to the secondary transfer bias.

The primary transfer roller 54*a* is a metal roller made of sulfur and sulfur composite free-cutting steel material (SUM) with electroless nickel processing (KN plating) on the surface or stainless steel (SUS). According to the present exemplary embodiment, the primary transfer roller 54*a* is a metal roller having a straight shape with a roller diameter of 8 mm which is almost constant along the axial direction.

The primary transfer roller 54*a* is disposed at a position where the area where the primary transfer roller 54*a* contacts the intermediate transfer belt 56 does not overlap with the area where the photosensitive drum 50*a* contacts the intermediate transfer belt 56 when viewed from the thickness direction of the intermediate transfer belt 56. In addition, the primary transfer roller 54*a* is disposed on the downstream side of the photosensitive drum 50*a* in the rotational direction of the intermediate transfer belt 56.

More specifically, the primary transfer roller 54*a* is disposed so that the distance B between the normal line drawn from the central axis of the photosensitive drum 50*a* to the intermediate transfer belt 56 and the normal line drawn from the central axis of the primary transfer roller 54*a* to the intermediate transfer belt 56 becomes 5.5 mm. Further, the primary transfer roller 54*a* is disposed to make inroads into the intermediate transfer belt 56 by 0.1 to 0.3 mm. This configuration reduces the contact pressure of the primary transfer roller 54*a* on the intermediate transfer belt 56. A possible method for making the primary transfer roller 54*a* in pressure contact with the intermediate transfer belt 56 is to urge a bearing for supporting the primary transfer roller 54*a* by using a spring.

[Density Unevenness]

Uneven image density due to an uneven current in the axial direction (longitudinal direction) of the primary transfer roller 54*a* will be described below with reference to FIG. 3. The intermediate transfer belt 56 is stretched by a plurality of support rollers as described above to be supported in a tension state. If there are portions with a large gap between the primary transfer roller 54*a* for toner image transfer and the intermediate transfer belt 56 and portions with a small or no gap therebetween in the longitudinal direction, uneven image density may possibly occur in the longitudinal direction.

The primary transfer roller 54*a* as a metal roller to which the primary transfer bias voltage is applied will be described below. The following description also applies to other primary transfer rollers 54*b*, 54*c*, and 54*d*. According to the present exemplary embodiment, the secondary inner transfer roller 62 is a rubber roller to which the secondary transfer bias voltage is applied via the secondary outer transfer roller 64 and the intermediate transfer belt 56. However, when the secondary inner transfer roller 62 is a metal roller, preferably, the secondary inner transfer roller 62 is configured in a similar way to the primary transfer roller 54*a*, except for the diameter.

Figure 3:
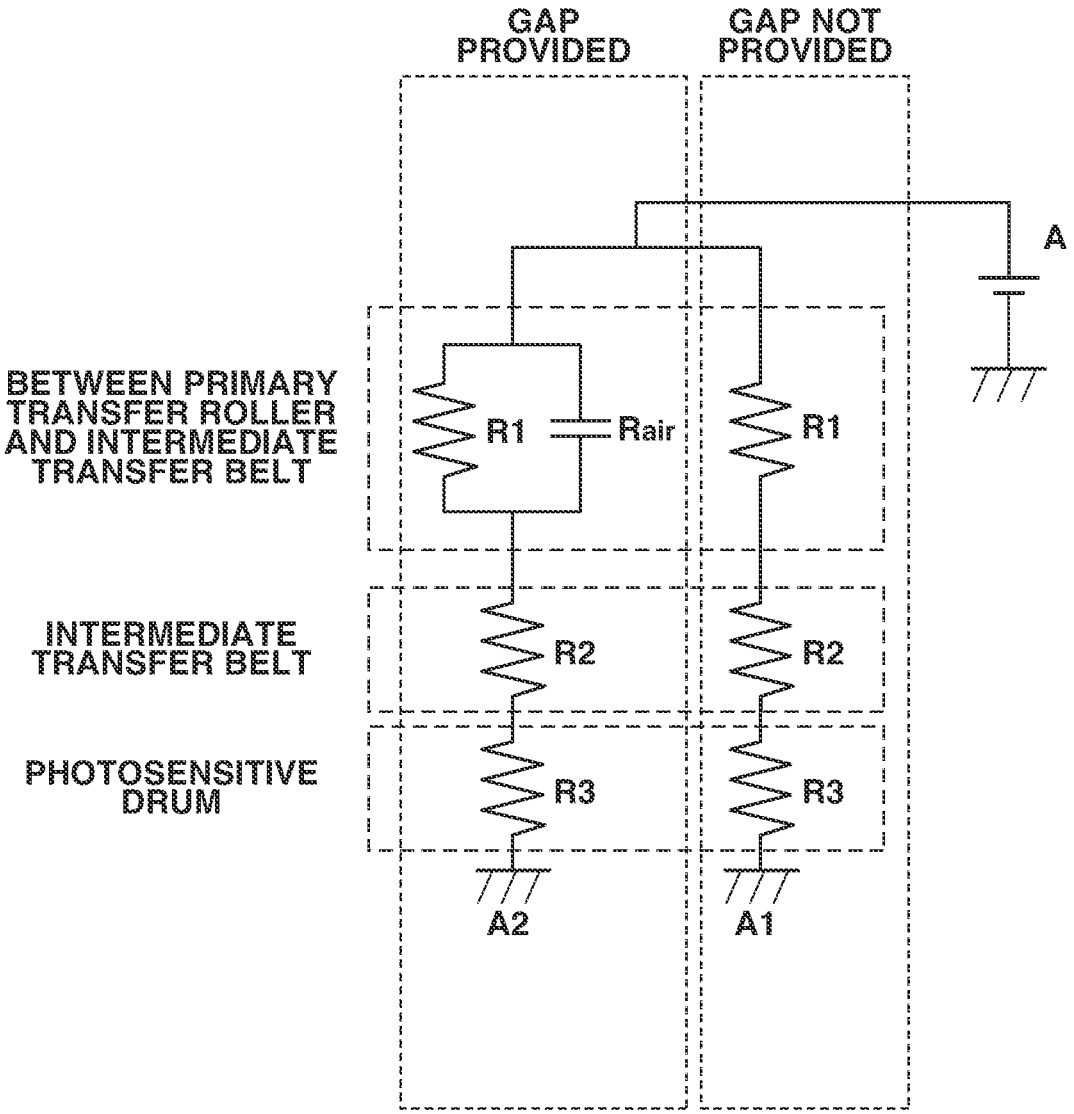
FIG. 3 is a circuit diagram illustrating a case where there is a gap between a primary transfer roller and an intermediate transfer belt and a case where there is no gap therebetween.

FIG. 3 schematically illustrates a current circuit for a portion with a gap and a portion with no gap in a longitudinal area where the primary transfer roller 54*a* and the intermediate transfer belt 56 contact with each other. Referring to FIG. 3, when a constant voltage is applied to the primary transfer roller 54*a*, the current circuit has a total current amount A.

At the portion with no gap (circuit on the right-hand side illustrated in FIG. 3), resistances which form the impedance of the system include a contact resistance R1 between the primary transfer roller 54*a* and the intermediate transfer belt 56, a resistance R2 of the intermediate transfer belt 56, and a resistance R3 of the photosensitive drum 50*a*. The circuit of the portion with no gap provides a current amount A1.

On the other hand, at the portion with a gap (circuit on the left-hand side illustrated in FIG. 3), resistances which form the impedance of the system include the contact resistance R1 between the primary transfer roller 54*a* and the intermediate transfer belt 56, and an air resistance Rair of the gap between the primary transfer roller 54*a* and the intermediate transfer belt 56. Similar to the case where there is no gap, resistances which form the impedance also include the resistance R2 of the intermediate transfer belt 56 and the resistance R3 of the photosensitive drum 50*a*. The circuit of the portion with a gap provides a current amount A2.

When a constant voltage is applied, the same voltage is applied to the circuit with a gap between the intermediate transfer belt 56 and the primary transfer roller 54*a*, and the circuit with no gap. As described above, the impedance of the system differs according to whether there is a gap between the intermediate transfer belt 56 and the primary transfer roller 54*a*. This means that the different current amounts A1 and A2 flow in the respective circuits. More specifically, an uneven current occurs in the longitudinal direction. If an uneven current occurs in the longitudinal direction, uneven density in the longitudinal direction occurs in the image to be transferred.

[Primary Transfer Rollers]

Therefore, according to the present exemplary embodiment, the primary transfer rollers 54*a*, 54*b*, 54*c*, and 54*d* are metal rollers having no groove formed on the surfaces, unlike the idler roller 61 (described below), having a metal surface with a smaller maximum surface height Ry than the idler roller 61. Preferably, the primary transfer rollers 54*a*, 54*b*, 54*c*, and 54*d* have a maximum surface height Ry of 25 μm or less. This point will be described below with reference to FIG. 4. Herein, the maximum surface height Ry is defined by the Japanese Industrial Standards B0031 (1994). Specifically, the maximum surface height Ry is a value in the unit of micrometer (μm) obtained by extracting a portion of a roughness curve by a reference length from the roughness curve in a direction of a mean line thereof and measuring a distance between a peak line and a valley line of the extracted portion of the roughness curve in a direction of a longitudinal magnification of the roughness curve.

Figure 4:
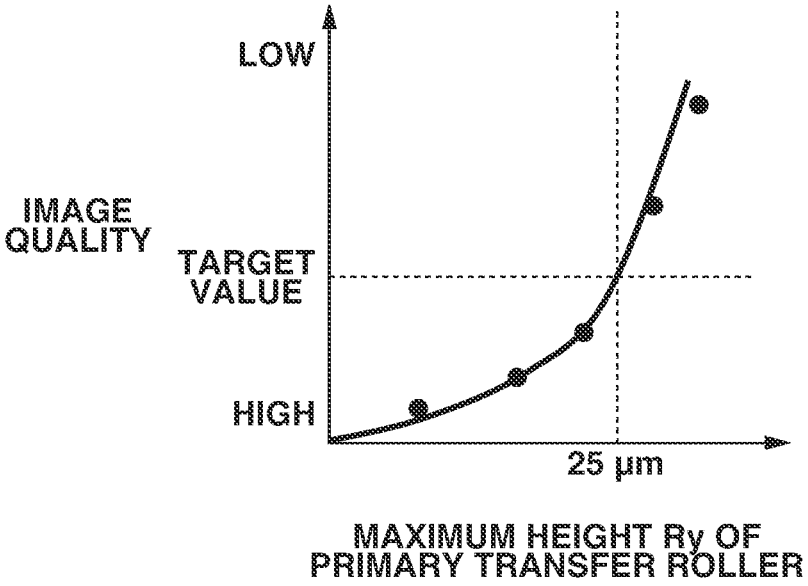
FIG. 4 is a graph illustrating a relation between the maximum surface height of the primary transfer roller and the image quality.

FIG. 4 illustrates a result of confirming the image quality of an image actually formed while varying the maximum surface height Ry of the primary transfer roller 54*a*. As a result of study, it was confirmed that, uneven density appeared in the image and the image quality was degraded when the maximum surface height Ry of the primary transfer roller 54*a* was larger than 25 μm. As described above, preferably, the maximum surface height Ry of the primary transfer roller 54*a* is 25 μm or less, more preferably, 10 μm or less, and still more preferably, 7 μm or less.

[Idler Roller]

Figure 5A:
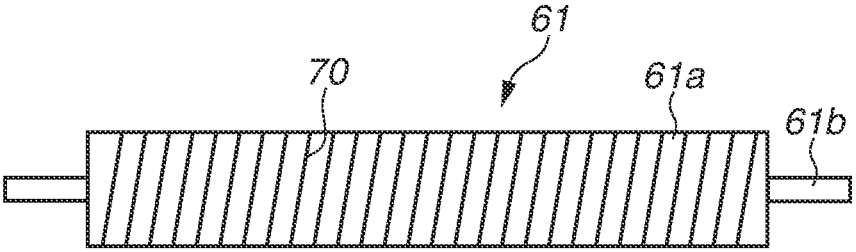
FIG. 5A is a schematic plan view illustrating an idler roller according to the exemplary embodiment.

At the primary transfer portion T1, the toner image is transferred to the intermediate transfer belt 56. After the surface (inner circumferential surface) opposite to the toner bearing surface of the intermediate transfer belt 56 passes through the primary transfer portion T1, the relevant inner circumferential surface first contacts the idler roller 61 as a support rotation member and then contacts the secondary inner transfer roller 62 (drive roller) as a support rotation member. More specifically, the idler roller 61 serves as a pre-drive roller which is adjacently disposed on the upstream side of the secondary inner transfer roller (drive roller) in the rotational direction of the intermediate transfer belt 56. As illustrated in FIG. 5A, a groove 70 as a concave portion is formed on the outer circumferential surface of the metal of the idler roller 61.

The groove 70 is formed in the direction intersecting with the axial direction of the idler roller 61. More specifically, the groove 70 is spirally formed on the outer circumferential surface of the idler roller 61 so as to cover the outer circumferential surface along the axial direction. The axial range of the idler roller 61 on which the groove 70 is formed covers at least the range in which the idler roller 61 is in contact with the intermediate transfer belt 56. According to the present exemplary embodiment, the idler roller 61 is composed of a roller portion 61*a* and axes 61*b* provided at both ends of the roller portion 61*a*. The axes 61*b* are rotatably supported, via bearings, by the frame for supporting each roller in the intermediate transfer belt 56. The groove 70 is formed over the entire axial area of the roller portion 61*a*. Instead of being continuously formed in spiral form, a plurality of groove portions may be formed in the direction intersecting with the axial direction (for example, in the circumferential direction intersecting with the axial direction). The groove 70 may also be formed in parallel with the axial direction of the roller portion 61*a*. However, preferably, the groove 70 is inclined by 60 degrees or more with respect to the axial direction.

The groove 70 also may be formed at least in the maximum image forming area of the roller portion 61*a*. Further, according to the present exemplary embodiment, the groove 70 (concave portion) is formed in approximately the entire maximum image forming area (substantially the entire area). The approximately the entire area refers to at least 90% or more.

As described above, the idler roller 61 is disposed on the downstream side of the primary transfer portion T1 for the proximate one of the plurality of support rollers for stretching and supporting the intermediate transfer belt 56. As illustrated in FIG. 1, the position of the area on the outer circumferential surface of the intermediate transfer belt 56 stretched by the idler roller 61 faces an optical sensor 90 for detecting a toner image for control such as a reference density toner image and a position information toner image. The accuracy in reading the toner image for control can be improved by detecting the toner image for control by using the sensor 90 in the area on the intermediate transfer belt 56 stretched by the idler roller 61.

The reference density toner image is formed to achieve a predetermined density. The density adjustment is performed on the toner image by adjusting the amount of developer supplied to the development apparatuses 53*a*, 53*b*, 53*c*, and 53*d* and adjusting various voltages based on the result of detecting the reference density toner image. The position information toner image is used to detect positional deviations between toner images of respective colors on the intermediate transfer belt 56. For example, the starting positions of exposure by the exposure apparatuses 52*a*, 52*b*, 52*c*, and 52*d* are adjusted based on the result of detecting the position information toner image.

The idler roller 61 is a metal roller formed of a cylindrical pipe made of stainless steel having an outer diameter of 21 mm as a conductive material. The idler roller 61 is connected to the ground potential, so that the idler roller 61 is not charged up. The idler roller 61 contacts the surface opposite to the toner bearing surface of the intermediate transfer belt 56 which is supplied with electric charges from the primary transfer rollers 54*a*, 54*b*, 54*c*, and 54*d* at the primary transfer portions T1. Therefore, failure to connect the idler roller 61 to the ground potential may cause the idler roller 61 to be charged up. When the idler roller 61 is charged up, a current may leak to surrounding components, possibly giving electrical stress to the electronic circuit of the image forming apparatus 100.

Since the idler roller 61 is adjacently disposed on the upstream side of the secondary inner transfer roller as a drive roller, the contact pressure with the intermediate transfer belt 56 tends to increase. Dust and carriers may enter the inside of the intermediate transfer belt 56. In this case, in the contact portion between the idler roller 61 supporting the intermediate transfer belt 56 in a tension state and the intermediate transfer belt 56, the pressure on the intermediate transfer belt 56 locally remarkably increases because of the height of dust and carriers. As a result, tension lines (described below) may occur on the intermediate transfer belt 56.

Therefore, according to the present exemplary embodiment, the above-described groove 70 is formed on the outer circumferential surface of the idler roller 61. This groove prevents the concentration of pressure when dust and carriers adhere to the inner circumferential surface of the intermediate transfer belt 56, thus preventing the occurrence of tension lines.

[Tension Lines]

The above-described tension lines will be described below. When the intermediate transfer belt 56 stretched and supported by the plurality of support rollers is driven to rotate, streak-like concavo-convex portions (tension lines) may occur on the intermediate transfer belt 56 along the conveyance direction of the intermediate transfer belt 56. Tension lines are like wrinkles occurring by uneven tensions applied to the intermediate transfer belt 56. Causes of uneven tensions include foreign substances such as dust and carriers getting into the back surface (inner circumferential surface) of the intermediate transfer belt 56. If dust and carriers enter between a support roller and the intermediate transfer belt 56, the pressure at a portion where dust and carriers exist in a contact portion between the support roller and the intermediate transfer belt 56 locally remarkably increases. Once such a foreign substance adheres to the support roller, the contact pressure with the intermediate transfer belt 56 locally increases each time the support roller rotates once. In this case, uneven tensions occur resulting in tension lines on the intermediate transfer belt 56. In particular, a small diameter of the support roller increases the contact pressure with the intermediate transfer belt 56. The large contact pressure easily causes a local pressure rise and accordingly tension lines. Therefore, it is known that tension lines are caused by the pressure between the support roller and the belt to a large extent.

As rotational drive is repeated, the concavo-convex size or the number of tension lines gradually increases. If tension lines occur on the intermediate transfer belt 56, concave-convex portions or microscopic degradations of the intermediate transfer belt 56 cause uneven transfer of toner at the transfer portion T1, resulting in an output of a streak-like image.

On the other hand, when a roller having a soft surface, such as a rubber roller with a rubber-coated metal core, is used, dust and carriers entering the contact portion between the support roller and the belt does not cause the application of a locally high pressure since the surface of the support roller is pressed to be deformed. However, it is difficult to use rubber rollers as all of the support rollers because of high costs. According to the present exemplary embodiment, therefore, the idler roller 61 as at least one of the plurality of support rollers for stretching the intermediate transfer belt 56 is a metal roller with the groove 70 (concave portion) being formed on the metal surface thereof.

[About Rollers]

The rollers disposed in the intermediate transfer belt 56 will be described below. FIG. 6 illustrates the materials and diameters of the rollers. As illustrated in FIG. 6, the primary transfer rollers 54*a*, 54*b*, 54*c*, and 54*d* to be applied with a voltage to transfer a toner image on the intermediate transfer belt 56 are (groove-less) metal rollers having no groove formed on the surface. Since the secondary inner transfer roller 62 also serves as a drive roller, a rubber roller having a surface wound with rubber is used as the secondary inner transfer roller 62 to avoid a slip between the intermediate transfer belt 56 and the secondary inner transfer roller 62. The plurality of support rollers for stretching the intermediate transfer belt 56, other than the secondary inner transfer roller 62, i.e., the support rollers 60 and 67, the tension roller 63, and the idler roller 61 are metal rollers.

In particular, the idler roller 61 has a diameter as small as 12 mm, as described above, and provides a large contact pressure with the intermediate transfer belt 56. Therefore, the idler roller 61 is a (grooved) metal roller having the groove 70 formed on the surface. The support roller 67 has a small diameter and provides a high contact pressure with the intermediate transfer belt 56. Therefore, the support roller 67 is a grooved metal roller similar to the idler roller 61. According to the present exemplary embodiment, the support roller 67 has a smaller outer diameter than any other support rollers. Although not illustrated in FIG. 6, according to the present exemplary embodiment, the support roller 60 is a grooved metal roller similar to the idler roller 61. The support rollers 60 and 67 may be groove-less metal rollers similar to the primary transfer roller 54*a*. However, when the diameter is small and the contact pressure with the intermediate transfer belt 56 is high, preferably, the support rollers 60 and 67 are grooved metal rollers similar to the present exemplary embodiment. This is because the high contact pressure between a support roller and the belt causes a local pressure rise by dust, as described above, possibility resulting in tension lines.

On the other hand, the tension roller 63 is a groove-less metal roller. This is because, when the tension roller 63 is a grooved metal roller, toner or paper powder adhered to the intermediate transfer belt 56 may not be completely removed by the belt cleaning apparatus 65. More specifically, the belt cleaning apparatus 65 brings a contact member such as a blade into contact with the outer circumferential surface of the intermediate transfer belt 56 in the area stretched by the tension roller 63 to scratch the toner on the belt. In this case, if the tension roller 63 has a groove, the contact pressure between the contact member and the belt may differ between grooved and groove-less portions. When the contact pressure becomes uneven in this way, toner and paper powder may possibly pass through at portions with a low contact pressure. Therefore, according to the present exemplary embodiment, the tension roller 63 is a groove-less metal roller. More specifically, the maximum surface height Ry of the tension roller 63 is smaller than the maximum surface height Ry of any other grooved rollers. Preferably, the maximum surface height Ry of the tension roller 63 is 25 μm or less, and the 10-point mean roughness Rz of the tension roller 63 is 5 μm or less. Further, the contact pressure with the intermediate transfer belt 56 is made as small as possible by making the diameter of the tension roller 63 (21 mm according to the present exemplary embodiment) larger than the diameters of any other grooved support rollers, thus preventing the occurrence of tension lines. According to the present exemplary embodiment, the tension roller 63 has a larger diameter than any other support rollers.

[Groove Configuration]

Figure 5B:
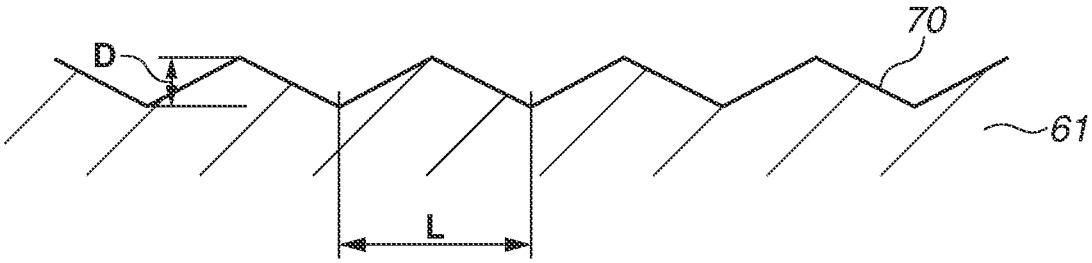
FIG. 5B is an enlarged cross-sectional view illustrating a surface portion of the idler roller.

The groove configuration of a metal roller with a groove formed as described above will be described below centering on the idler roller 61 as an example. As described above, the idler roller 61 has the spirally formed groove 70. As illustrated in FIG. 5B, according to the present exemplary embodiment, when the groove 70 has an axial pitch (groove forming width) L and a groove height D, the groove pitch L is set to 50 μm or more and 5 mm or less. Preferably, the groove pitch L is 1000 μm or less, more preferably, 500 μm or less, and still more preferably, 300 μm or more and 400 μm or less. According to the present exemplary embodiment, the groove height D is set to 10 μm or more. Preferably, the groove height D is 120 μm or less, more preferably, 10 μm or more and 40 μm or less, and still more preferably, 20 μm or more and 40 μm or less. The groove pitch L and the groove height D may be identical or different along the longitudinal direction of the idler roller 61. However, even when the groove pitch L and the groove height D are different in the longitudinal direction, preferably, these values are within the above-described ranges.

The groove pitch L refers to the interval between axial centers or between deepest points (peaks) of adjacent valley portions across a mountain portion. The groove height D refers to the radial interval between axial centers of adjacent mountain and valley portions or between peaks of adjacent mountain and valley portions. According to the present exemplary embodiment, as illustrated in FIG. 5B, the groove 70 is shaped in such a way that the cross-sectional shape along the axial direction includes axially continuous mountain and valley portions having triangular profiles. Therefore, the groove pitch L refers to the interval between peaks of axially adjacent valley portions, and the groove height D refers to the radial interval between peaks of adjacent mountain and valley portions.

If the groove pitch L is too small, a foreign substance may be caught in the groove. In this case, a local pressure rise by dust or carriers caught up may not be sufficiently prevented. Therefore, preferably, the groove pitch L is larger than the carrier diameter rc (number average particle diameter). More preferably, the ratio of the groove pitch L to the carrier diameter rc is 2 or more. If the groove pitch L is too large, the number of contact points between the roller and the belt decreases, resulting in an excessive contact pressure for each peak of the groove. If the belt is profiled by unevenness, a local pressure rise by dust or carriers caught up may not be sufficiently prevented.

The particle size distribution of magnetic carriers is measured by using the SALD-3000 Laser Diffraction Particle Size Analyzer (Shimadzu Corporation) according to the operation manual of the measuring apparatus. More specifically, in the measurement, 0.1 g of the magnetic carrier was introduced into the apparatus, the number of samples was measured for each channel to calculate the median size d50, and the resultant value was recognized as the number average particle diameter rc of the sample.

If the groove height D is too small, a local pressure rise by dust or carriers caught up may not be sufficiently prevented. Therefore, preferably, the ratio of the groove height D to the carrier diameter rc is ⅔ or more, and more preferably, 1 or more. If the groove height D is too large, the strength of the roller will be degraded. Therefore, preferably, the ratio the groove height D to the carrier diameter rc is 4 or less, and more preferably, 2 or less.

If the angle of a peak of the groove is too small, the belt may be possibly damaged. If the peak of the groove is too flat, a local pressure rise by dust or carriers caught up may not be sufficiently prevented. Therefore, preferably, the ratio of the groove pitch L to the groove height D is 3 or more and 10 or less.

According to the present exemplary embodiment, the maximum surface height Ry of the surface of a grooved support roller is set to be larger than the maximum surface height Ry of the surface of a groove-less transfer roller by 10 μm or more.

The cross-sectional shape along the axial direction of the groove 70 may have circular arc and trapezoidal profiles in addition to triangular profiles. However, for the mountain portion between valley portions, it is preferable that a short or no planar surface exists. This is because the contact pressure on the intermediate transfer belt 56 is likely to locally increase when dust gets on this planar surface. Therefore, preferably, the cross-sectional shape along the axial direction of the groove 70 includes continuous triangular profiles like the present exemplary embodiment or continuous circular arc profiles like a sine wave.

It is desirable that the pitch of adjacent ridgelines of the groove 70 is smaller than a limit width at which the intermediate transfer belt 56 being stopped and in contact with the groove surface is not permanently deformed, and that the depth of the groove 70 is larger than a limit depth at which the intermediate transfer belt 56 being stopped and supported is in contact with the groove surface.

When the groove pitch L is smaller than 300 μm, even if dust and carriers enter the groove when dust and carriers enter between the intermediate transfer belt 56 and the idler roller 61, the amount of dust or carriers protruding from the groove is likely to be large. Therefore, a local pressure rise by dust or carriers caught up may not be sufficiently prevented.

Figure 7A:
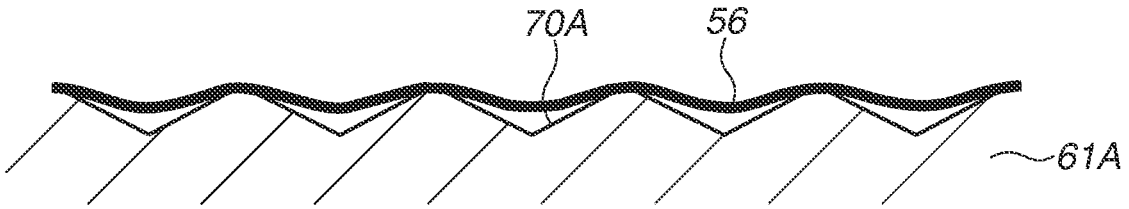
FIG. 7A is an enlarged cross-sectional view illustrating a surface portion of the intermediate transfer belt and a surface portion of the idler roller.
Figure 7B:
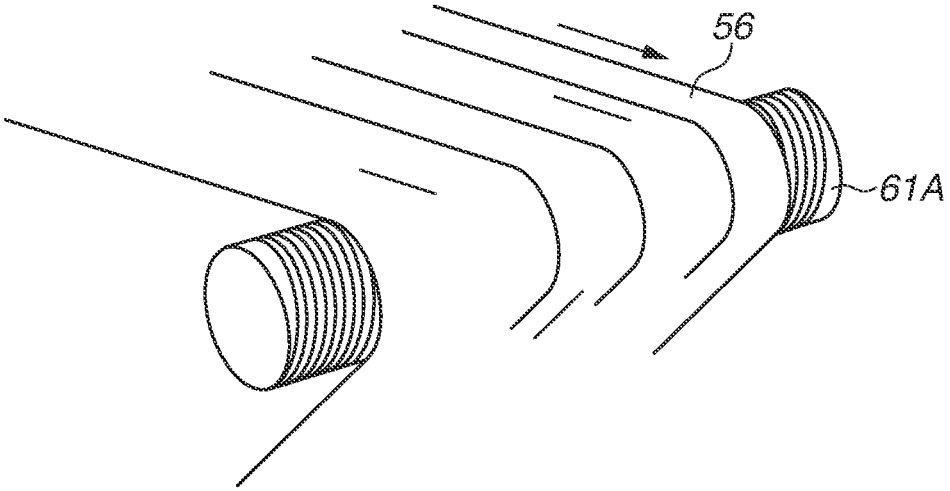
FIG. 7B is a perspective view illustrating the intermediate transfer belt and the idler roller, in a case of a large groove pitch.

On the other hand, as illustrated in FIG. 7A, when the intermediate transfer belt 56 is stretched by an idler roller 61A on which a groove 70A having a larger groove pitch L than 400 μm is formed, the deflected intermediate transfer belt 56 may make remarkable inroads into the valley portions of the groove 70A. As a result, as illustrated in FIG. 7B, waves may occur on the intermediate transfer belt 56 in the stretching area by the idler roller 61A.

L denotes the groove pitch [mm], d denotes the thickness [mm] of the intermediate transfer belt 56, b denotes the amount of the intermediate transfer belt 56 wound around the idler roller 61 [mm], P denotes the tension per unit length [N/cm] to be applied to the intermediate transfer belt 56, and E denotes Young's modulus [GPa] of the intermediate transfer belt 56. Under this condition, the distortion amount h [mm] is estimated by the following formula (1) as the deflection amount of a double-end supported beam of which the rotation of both ends is restrained.

$$h=\frac{1}{4}*(L/(d*b))*(P/E)*106 \quad (1)$$

Figure 8:
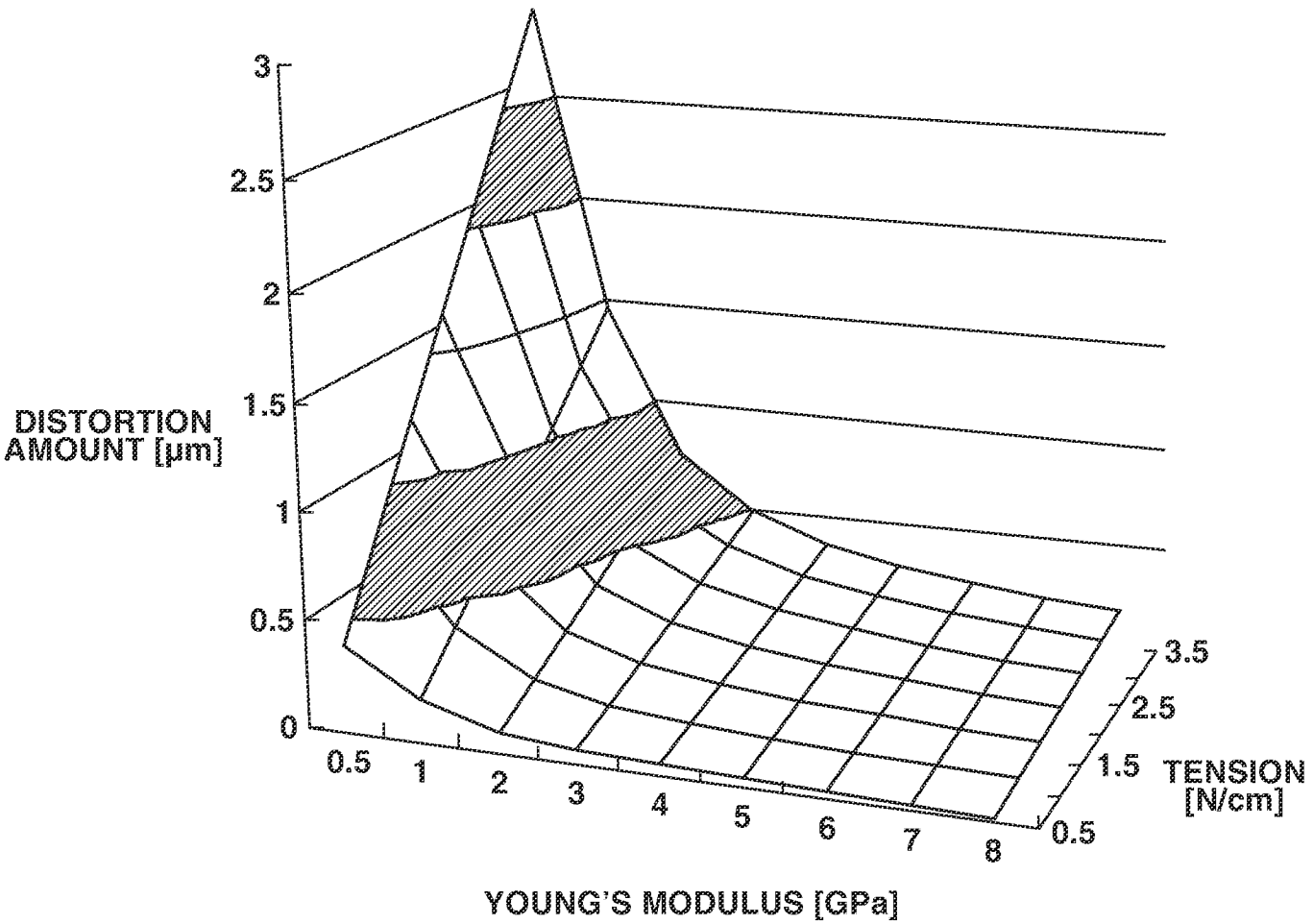
FIG. 8 is a graph illustrating a relation between Young's modulus, tension, and distortion amount of the intermediate transfer belt wound around the idler roller.

FIG. 8 illustrates the distortion amount h of the intermediate transfer belt 56 obtained by using the formula (1) while varying the tension and Young's modulus of the intermediate transfer belt 56 when the amount b of the intermediate transfer belt 56 wound around the idler roller 61 is 25 mm and the groove pitch L of the groove 70 is 400 μm. Referring to FIG. 8, when the intermediate transfer belt 56 has a tension of 3.5 N/cm and a Young's modulus of 1.14 GPa, the maximum distortion amount, i.e., the depth of inroads of the intermediate transfer belt 56 into the valley portions of the groove 70 is estimated to be about 3.5 μm.

When the intermediate transfer belt 56 is actually driven to rotate, there arise variations in Young's modulus in the belt surface and variations in tension in the longitudinal direction. Therefore, preferably, the groove height D of the idler roller 61 has a margin with respect to 3.5 μm, more specifically, the groove height D is set to 10 μm or more.

On the other hand, when the groove height D is larger than 40 μm, applying the above-described tension to the intermediate transfer belt 56 may cause an excessive deflection amount at the central portion of the idler roller 61. This is because, as a result of groove processing in the circumferential direction applied to the surface of the idler roller 61 as a roller member formed of a metal tube, the bending rigidity of the idler roller 61 in the longitudinal direction is degraded and the deflection amount increases. Therefore, preferably, the groove height D is 40 μm or less.

As described above, according to the present exemplary embodiment, it is possible to prevent the occurrence of not only tension lines but also uneven density of a transfer image. More specifically, the primary transfer rollers 54*a*, 54*b*, 54*c*, and 54*d* to be applied with a voltage for transferring a toner image to the intermediate transfer belt 56 are groove-less metal rollers having a smaller maximum surface height Ry than the idler roller 61, as described above. Therefore, an uneven current does not easily occur in the axial direction, preventing the occurrence of uneven density of the transfer image. Since the primary transfer rollers 54*a*, 54*b*, 54*c*, and 54*d* are in contact with the intermediate transfer belt 56 with a small pressure, tension lines do not occur even when groove-less metal rollers are used.

On the other hand, the idler roller 61 as at least one of the plurality of support rollers for stretching the intermediate transfer belt 56 is a metal roller with the groove 70 formed on the surface, as described above. Therefore, even if dust or carriers enter contact portions between the intermediate transfer belt 56 and the idler roller 61, the contact pressure on the intermediate transfer belt 56 is not locally increased because the dust and the carriers enter the groove 70. As a result, the occurrence of tension lines can be prevented.

In particular, according to the present exemplary embodiment, the groove 70 is formed on the idler roller 61 as a pre-drive roller of which the contact pressure on the intermediate transfer belt 56 is likely to increase. Therefore, the occurrence of tension lines can be effectively prevented. In addition, the support rollers 60 and 67 of which the contact pressure on the intermediate transfer belt 56 is likely to increase are also metal rollers having a groove formed on the surface. Therefore, the occurrence of tension lines can be prevented. As described above, grooved support rollers are not applied with a voltage for toner image transfer, and therefore do not affect uneven density of an image.

According to the above-described exemplary embodiment, preferably, the maximum surface height of the primary transfer rollers 54*a*, 54*b*, 54*c*, and 54*d* is 25 μm or less. However, in addition to this, it is preferable that the surface roughness (10-point mean roughness Rz) of the primary transfer rollers 54*a* 54*b*, 54*c*, and 54*d* is 5 μm or less.

When the primary transfer rollers 54*a*, 54*b*, 54*c*, and 54*d* as metal rollers applied with a high voltage have a large surface roughness, a gap arises between the primary transfer rollers and the intermediate transfer belt 56, and electric discharge may possibly occur between the primary transfer rollers and the intermediate transfer belt 56. If electric discharge occurs, a damage due to the stress may cause an insulation breakdown arising on a part of the intermediate transfer belt 56, possibly resulting in a local transfer failure. In particular, this problem is likely to occur when a resin such as polyamide having a low electrical withstand voltage, or a low-dispersibility material made of conductive particles such as carbon black is used for the intermediate transfer belt 56.

Such a problem can be prevented from easily occurring by setting the 10-point mean roughness Rz of the surface of the primary transfer rollers 54*a*, 54*b*, 54*c*, and 54*d* to 5 μm or less.

Although, in the above-described exemplary embodiment, the groove is a concave portion formed on a support roller such as the idler roller 61, the groove may be, for example, a plurality of convex portions formed on the surface of the support roller. For example, small concave portions having circular and polygonal profiles in plan view may be formed over the entire surface of the support rollers.

Of the metal rollers not applied with a voltage (transfer bias), preferably, a concave portion is formed on rollers having a high contact pressure with the intermediate transfer belt 56 and a small diameter. Therefore, depending on the configuration of an image forming apparatus, a concave portion may be formed on at least one support roller other than the idler roller 61. For example, if the idler roller has a large diameter and is unlikely to involve the occurrence of tension lines even without forming a concave portion thereon, a concave portion may be formed on support rollers other than idler roller 61.

The idler roller 61 is not provided in some image forming apparatuses. In this case, a concave portion is formed on the surface of at least one of metal rollers for stretching the intermediate transfer belt, not applied with a voltage (transfer bias). Also in this case, preferably, a concave portion is formed on rollers having a high contact pressure with the intermediate transfer belt and a small diameter.

According to the above-described exemplary embodiment, the primary transfer rollers 54*a*, 54*b*, 54*c*, and 54*d* are groove-less metal rollers, and the secondary inner transfer roller 62 is a rubber roller. However, the secondary inner transfer roller 62 may also be a groove-less metal roller similar to the primary transfer roller 54*a*. More specifically, a first roller (for example, the idler roller 61) as at least one of the plurality of support rollers for stretching the intermediate transfer belt 56 is a metal roller having a concave portion formed on the metal surface thereof. In this case, a second roller as at least either the primary transfer rollers 54*a*, 54*b*, 54*c*, and 54*d* or the secondary inner transfer roller 62 is a metal roller having a metal surface with a smaller maximum height of the surface roughness than the first roller.

Although the above-described exemplary embodiment has been described centering on a printer as an image forming apparatus, the image forming apparatus may be a copying machine, facsimile, or multifunction peripheral instead of a printer.

According to the present disclosure, it is possible to prevent the occurrence of not only tension lines but also uneven density of a transfer image.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-068880, filed Mar. 30, 2017, which is hereby incorporated by reference herein in its entirety.

What is claimed is:

1. A transfer unit attachable to and detachable from an image forming apparatus, the transfer unit comprising:

an endless intermediate transfer belt configured to hold a toner image transferred from an image bearing member;

a plurality of support rollers configured to stretch the intermediate transfer belt, the plurality of support rollers including a metal roller made of a metal; and a transfer roller made of a metal, configured to contact an inner surface of the intermediate transfer belt to form a transfer portion, and transfer the toner image borne by the image bearing member to the intermediate transfer belt when a transfer bias is applied to the transfer roller, wherein the metal roller has a plurality of concave portions, the concave portions being formed in 90% or more of an area corresponding to an image forming area, and each of the concave portions having a depth of 10 μm or more and a width of 50 μm or more and 5 mm or less, wherein the transfer roller has a maximum surface height Ry of 25 μm or less in the image forming area, and wherein the maximum surface height Ry of the metal roller is larger than the maximum surface height Ry of the transfer roller by 10 μm or more.

2. The transfer unit according to claim 1, wherein the plurality of support rollers includes a drive roller, the drive roller rotatably driving the intermediate transfer belt, and the metal roller is adjacently disposed on an upstream side of the drive roller in a rotational direction of the intermediate transfer belt.

3. The transfer unit according to claim 1, wherein the metal roller has a smallest diameter out of the plurality of support rollers.

4. The transfer unit according to claim 1, wherein the metal roller is disposed on an upstream side of a secondary transfer portion, at which the toner image formed on the intermediate transfer belt is transferred to a recording material, and on a downstream side of the transfer portion in the rotational direction of the intermediate transfer belt.

5. The transfer unit according to claim 1, further comprising:

a blade configured to remove transfer residual toner on the intermediate transfer belt, wherein the plurality of support rollers includes an opposing roller made of a metal, configured to oppose the blade via the intermediate transfer belt, and wherein the opposing roller has a maximum surface height Ry of 25 μm or less and has a 10-point mean surface roughness Rz of 5 μm or less at an area corresponding to the image forming area, and has a largest diameter out of the plurality of support rollers.

6. The transfer unit according to claim 1, wherein the concave portions are formed along an axial direction of the metal roller.

7. The transfer unit according to claim 1, wherein the concave portions are formed by a spiral groove formed along a circumferential direction of the metal roller.

8. The transfer unit according to claim 1, wherein a ratio of the width of each of the concave portions to the depth thereof is 3 or more and 10 or less.

9. The transfer unit according to claim 1, further comprising a development apparatus configured to develop the latent image formed on the image bearing member by using a developer containing toner and carrier particles, wherein a ratio of the width of each of the concave portions to a diameter of the carrier particles is 1 or more.

10. The transfer unit according to claim 1, further comprising a development apparatus configured to develop the latent image formed on the image bearing member by using a developer containing toner and carrier particles, wherein a ratio of the width of each of the concave portions to the diameter of the carrier particles is 2 or more.

11. The transfer unit according to claim 1, wherein the concave portions are formed in a pitch of 300 μm or more and 400 μm or less along an axial direction of the metal roller.

12. The transfer unit according to claim 1, wherein the width of each of the concave portions is 1000 μm or less.

13. The transfer unit according to claim 1, wherein the width of each of the concave portions is 500 μm or less.

14. The transfer unit according to claim 1, further comprising a development apparatus configured to develop the latent image formed on the image bearing member by using a developer containing toner and carrier particles, wherein a ratio of the depth of each of the concave portions to the diameter of the carrier particles is ⅔ or more.

15. The transfer unit according to claim 1, wherein the depth of each of the concave portions is 120 μm or less.

16. The transfer unit according to claim 1, wherein the depth of each of the concave portions is 10 μm or more and 40 μm or less.

17. The transfer unit according to claim 1, wherein the depth of each of the concave portions is 20 μm or more and 40 μm or less.

18. The transfer unit according to claim 1, wherein the transfer roller has a maximum surface height Ry of 10 μm or less in the image forming area.

19. The transfer unit according to claim 5, wherein the transfer roller has a maximum surface height Ry of 0.4 μm or more in the image forming area.

20. The transfer unit according to claim 1, wherein the transfer roller has a 10-point mean surface roughness Rz of 5 μm or less.

* * * * *